US010895032B2

(12) United States Patent
Han et al.

(10) Patent No.: US 10,895,032 B2
(45) Date of Patent: Jan. 19, 2021

(54) VIBRATION SQUEEZE DRUM WASHING MACHINE

(71) Applicants: Yalan Han, Foshan (CN); Chao Han, San Diego, CA (US)

(72) Inventors: Yalan Han, Foshan (CN); Chao Han, San Diego, CA (US)

( * ) Notice: Subject to any disclaimer, the term of this patent is extended or adjusted under 35 U.S.C. 154(b) by 0 days.

(21) Appl. No.: 16/638,508

(22) PCT Filed: Jan. 8, 2019

(86) PCT No.: PCT/CN2019/070745

§ 371 (c)(1),
(2) Date: Feb. 12, 2020

(87) PCT Pub. No.: WO2019/179220

PCT Pub. Date: Sep. 26, 2019

(65) Prior Publication Data

US 2020/0370220 A1 Nov. 26, 2020

(30) Foreign Application Priority Data

Mar. 23, 2018 (CN) ..... 2018 1 0247407

(51) Int. Cl.

| | |
|---|---|
| ***D06F 15/02*** | (2006.01) |
| ***D06F 19/00*** | (2006.01) |
| ***D06F 23/02*** | (2006.01) |
| ***D06F 39/14*** | (2006.01) |
| ***D06F 15/00*** | (2006.01) |
| ***D06F 13/00*** | (2006.01) |
| ***D06F 13/06*** | (2006.01) |

(52) U.S. Cl.

CPC ..... *D06F 15/02* (2013.01); *D06F 19/00* (2013.01); *D06F 23/02* (2013.01); *D06F 13/00* (2013.01); *D06F 13/06* (2013.01); *D06F 15/00* (2013.01); *D06F 23/025* (2013.01); *D06F 39/14* (2013.01)

(58) Field of Classification Search

CPC ..... D06F 13/00; D06F 13/06; D06F 15/00; D06F 15/02; D06F 19/00; D06F 23/02; D06F 23/025; D06F 39/14

See application file for complete search history.

(56) References Cited

U.S. PATENT DOCUMENTS 1,413,825 A * 4/1922 Benedict ..... D06F 15/00 68/50
1,832,079 A * 11/1931 Adams ..... D06F 15/00 68/113

(Continued)

FOREIGN PATENT DOCUMENTS

CN 1644784 A 7/2005
CN 103696201 A 4/2014

(Continued)

*Primary Examiner* — Joseph L. Perrin
(74) *Attorney, Agent, or Firm* — IPro, PLLC

(57) ABSTRACT

A vibration squeeze drum washing machine includes a housing, a barrel, a drum, a machine door, a vibration squeeze device, a turnover mechanism, a mechanical vibrator, a position sensor, a drum motor, a drive device, a water intake valve, a drainage valve, and a control system. The vibration squeeze device is disposed on an inner side of the machine door and is connected to the machine door via the turnover mechanism.

4 Claims, 3 Drawing Sheets

(56) References Cited

U.S. PATENT DOCUMENTS

| | | | | | |
|---|---|---|---|---|---|
| 2,305,956 | A * | 12/1942 | Dyer | D06F 15/00 | 68/97 |
| 2,629,244 | A * | 2/1953 | Rand | D06F 58/00 | 68/21 |
| 3,039,842 | A * | 6/1962 | Hajos | D06F 19/00 | 8/159 |
| 3,410,116 | A * | 11/1968 | Levinson | A47L 15/0097 | 68/3 R |
| 2002/0134117 | A1* | 9/2002 | Arai | D06F 19/00 | 68/3 SS |

FOREIGN PATENT DOCUMENTS

| | | | |
|---|---|---|---|
| CN | 205012038 | U | 2/2016 |
| CN | 205839398 | U | 12/2016 |
| CN | 108277614 | A | 7/2018 |
| CN | 208395495 | U | 1/2019 |
| KR | 20040050681 | A | 6/2004 |

* cited by examiner

VIBRATION SQUEEZE DRUM WASHING MACHINE

TECHNICAL FIELD

The disclosure relates to the field of washing machines, and more particularly to a vibration squeeze drum washing machine.

BACKGROUND

Conventional drum washing machines include a drum wall and a lifting rib disposed on the drum wall. The clothes are lifted by the lifting rib to a certain height and then falls off to produce tumbling and friction effect, thus achieving the purpose of washing the clothes. However, the washing mode is time-consuming, and the washing effect is not good. Thus, developing a novel drum washing machine with new structure has become one of the hot spots in the field of washing machine technology.

SUMMARY

To overcome the above mentioned defects, there provided is a vibration squeeze drum washing machine that has a simple structure and adopts a combination washing mode of vibration and squeeze.

To achieve the above objective, the following technical solutions are adopted.

Provided is a vibration squeeze drum washing machine, comprising a housing, a barrel, a drum, a machine door, a vibration squeeze device, a turnover mechanism, a mechanical vibrator, a position sensor, a drum motor, a drive device, a water intake valve, a drainage valve, and a control system. The vibration squeeze device is disposed on the inner side of the machine door and is located in a recess of an observation window of the machine door.

As an improvement, the vibration squeeze device is connected to the machine door via the turnover mechanism. The turnover mechanism enables the vibration squeeze device to turn up and down at 90 degrees relative to the door.

In the upturning position, the axis of the vibration squeeze device is parallel to the machine door.

In the downturning position, the axis of the vibration squeeze device is perpendicular to the machine door, and the vibration squeeze device extends into the lower part of the drum.

As an improvement, the turnover mechanism comprises a motor, a worm, and a worm wheel; the worm is connected to the worm wheel; the motor is connected to the worm; the worm wheel is connected to the vibration squeeze device; the motor drives the worm to rotate to realize the vibration squeeze device to overturn.

As an improvement, the vibration squeeze device is connected to the worm wheel via an elastic part, so that the vibration squeeze device can oscillate elastically when encountering large resistance.

As an improvement, the position sensor is disposed on the machine door; the level signal of the position sensor is input to the input end of the control system to accurately sense the overturn state of the vibration squeeze device.

As an improvement, the vibration squeeze device comprises an inner chamber and a mechanical vibrator disposed in the inner chamber; the connection and disconnection of the power supply of the mechanical vibrator are controlled by the control system of the washing machine. The vibration squeeze device can be either a vibrator specially designed for the washing machine or a general industrial vibrator.

As an improvement, the vibration squeeze device further comprises a plurality of raised vibration heads.

The configurations of the vibration squeeze drum washing machine, such as water intake, water drainage, water level control, clothing weight and dehydration balance adjustment, are basically the same as that of the existing drum washing machines.

The laundry process of the vibration-squeeze type drum washing is different from that of the existing drum washing machines. The washing of clothes is mainly accomplished by the vibration squeeze device extending into the drum. The main function of the rotation of the drum is to overturn the clothes in the washing and rinsing process and dehydrate the clothes in the dehydration process.

Only when the vibration squeeze device is in the upturning vertical position can the drum rotate. Only when the drum stops rotation completely does the vibration squeeze device turn downwards and extend into the drum. It is the vibration squeeze device that turns downwards into the drum to vibrate, extrude, and wash the clothes.

After finishing vibrating, squeezing, and washing the clothes once, the vibration squeeze device will turn up automatically. After the vibration squeeze device is turned up in place, the drum rotates several times at low speed to overturn the clothes.

After rotating several circles, the drum stops rotating, and the vibration squeeze device turns downwards and vibrates again . . . . Several circles (preset by the procedure) later, the washing process is completed.

After the washing process, the water is filled in and drained out of the washing machine for several times, the drum rotates for several times at intervals, and the vibration squeeze device also turns downwards and vibrates for several times to rinse the clothes.

After the rinsing process, the vibration squeeze device stays in the upturning position, and the drum rotates rapidly to dehydrate the clothes.

After the dehydration process, the washing machine sends out a warning tone reminding that the laundry process has been completed, and then open the machine door and take out the laundry.

Advantages of the vibration squeeze drum washing machine of the disclosure are summarized as follows:

(1) The vibration squeeze drum washing machine improves the washing cleanliness, shortens the running time and reduces the power consumption. Compared with the existing drum washing machines, the vibration squeeze drum washing machine has better washing cleanliness and better energy-saving effect.

(2) The existing drum washing machines utilize the rotating inner drum to lift up the clothes to a certain height and then drop the clothes to achieve the washing effect. Only when the diameter of the drum is large enough can the clothes be raised to the required height. The vibration squeeze drum washing machine of the disclosure achieves the washing effect by vibrating and squeezing the clothes, so that the diameter of the drum can be reduced, the overall size of the drum washing machine can be reduced, and so can the overall weight of the drum washing machine.

DETAILED DESCRIPTION

To further illustrate, embodiments detailing a vibration squeeze drum washing machine are described below. It should be noted that the following embodiments are intended to describe and not to limit the disclosure.

Figure 1:
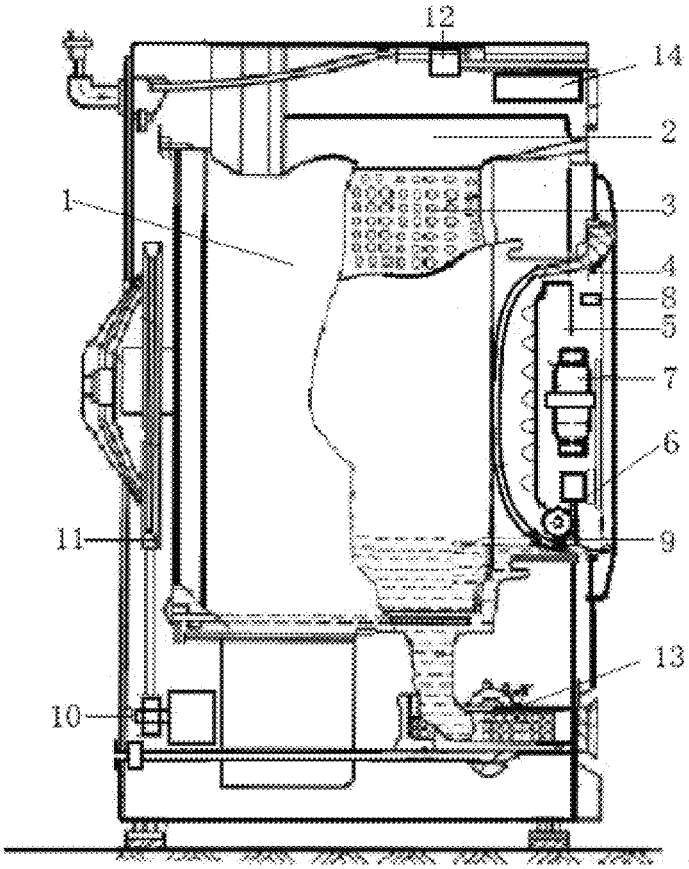
FIG. 1 is a schematic diagram of a vibration squeeze drum washing machine of the disclosure.
Figure 2:
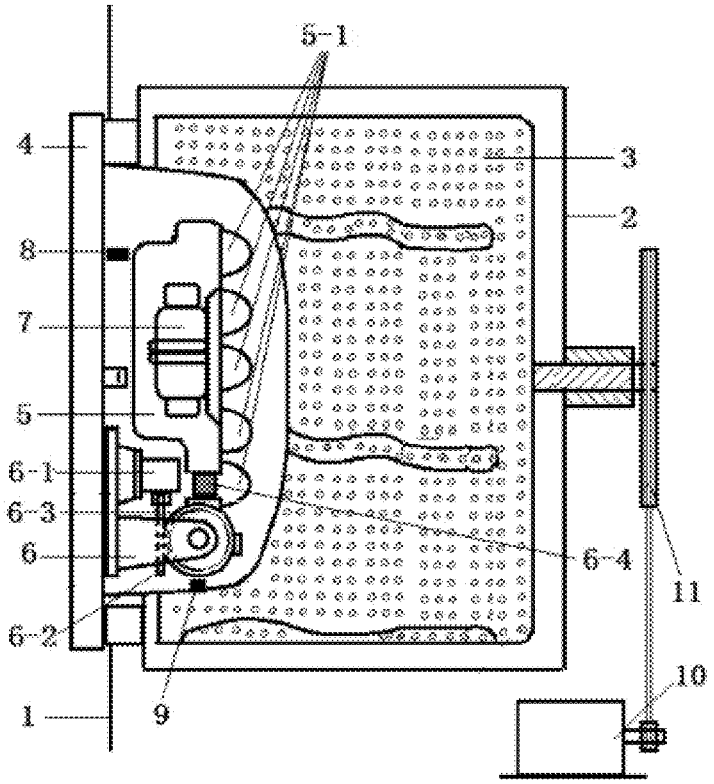
FIG. 2 is a schematic diagram of a vibration squeeze drum washing machine of which the vibration squeeze device is in the upturning position parallel to the machine door of the disclosure.
Figure 3:
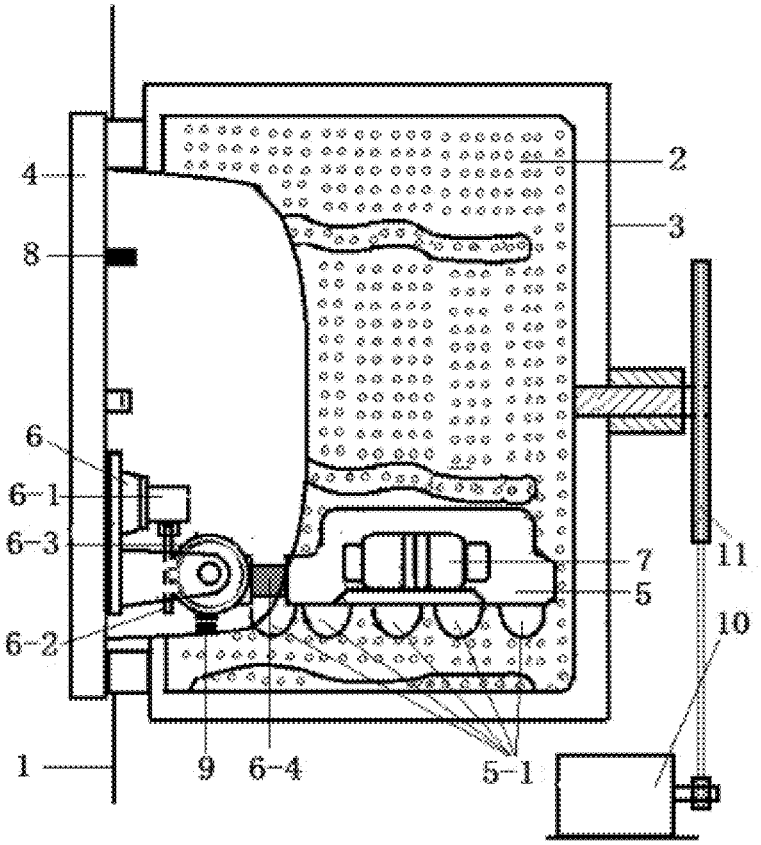
FIG. 3 is a schematic diagram of a vibration squeeze drum washing machine of which the vibration squeeze device is in the downturning position perpendicular to the machine door of the disclosure.

As shown in FIGS. 1-3, a vibration squeeze drum washing machine comprises a housing 1, a barrel 2, a drum 3, a machine door 4, a vibration squeeze device 5, a turnover mechanism 6, a mechanical vibrator 7, a position sensor 8, 9, a main motor 10, a drive device 11, a water intake valve 12, a drainage valve 13, and a control system 14. The vibration squeeze device 5 is disposed on the inner side of the machine door 4 and is located in a recess of an observation window of the machine door 4. The vibration squeeze device is connected to the machine door 4 via the turnover mechanism 6. The turnover mechanism 6 enables the vibration squeeze device 5 to turn up and down at 90 degrees relative to the machine door, as shown in FIGS. 1-3.

The turnover mechanism 6 comprises a motor 6-1, a worm 6-2, and a worm wheel 6-3; the worm 6-2 is connected to the worm wheel 6-3; the motor 6-1 is connected to the worm 6-2; the worm wheel 6-3 is connected to the vibration squeeze device 5. When the motor 6-1 rotates in one direction or in the opposite direction, through the transmission of the worm 6-2 and the worm wheel 6-3, the vibration squeeze device 5 can turn up or down, as shown in FIGS. 2-3.

In addition to the worm and the worm wheel mechanism, the turnover mechanism 6 can also adopt a deceleration step motor or a deceleration servo motor. The rotating shaft of the deceleration step motor or the deceleration servo motor is directly connected to the rotating shaft of the vibration squeeze device 5.

The vibration squeeze device 5 further comprises a plurality of raised vibration heads 5-1 so as to improve the vibration and squeeze effect upon contacting the clothes.

The vibration squeeze device is connected to the worm wheel 6-3 via an elastic part 6-4, so that the vibration squeeze device 5 can oscillate elastically when encountering large resistance, as shown in FIGS. 2-3.

The position sensors 8, 9 are disposed on the machine door; the level signal of the position sensor is input to the input end of the control system 14 to accurately sense the overturn state of the vibration squeeze device.

The inner chamber of the vibration squeeze device 5 is provided with a mechanical vibrator 7; the connection and disconnection of the power supply of the mechanical vibrator are controlled by the control system 14 of the washing machine. The vibration squeeze device can be either a vibrator specially designed for the washing machine or a general industrial vibrator.

The configurations of the vibration squeeze drum washing machine, such as water intake, water drainage, water level control, clothing weight and dehydration balance adjustment, are basically the same as that of the existing drum washing machines.

The laundry process of the vibration-squeeze type drum washing is different from that of the existing drum washing machines. The washing of clothes is mainly accomplished by the vibration squeeze device. The main function of the rotation of the drum is to overturn the clothes in the washing and rinsing process and dehydrate the clothes in the dehydration process.

Only when the vibration squeeze device is in the upturning position can the drum rotate. Only when the drum stops rotation completely does the vibration squeeze device turn downwards and extend into the drum. It is the vibration squeeze device that turns downwards into the drum to vibrate, extrude, and wash the clothes.

After finishing vibrating, squeezing, and washing the clothes once, the vibration squeeze device will turn up automatically. After the vibration squeeze device is turned up in place, the drum rotates several times at low speed to overturn the clothes.

After rotating several circles, the drum stops rotating, and the vibration squeeze device turns downwards and vibrates again . . . . Several circles (preset by the procedure) later, the washing process is completed.

After the washing process, the water is filled in and drained out of the washing machine for several times, the drum rotates for several times at intervals, and the vibration squeeze device also turns downwards and vibrates for several times to rinse the clothes.

After the rinsing process, the vibration squeeze device stays in the upturning position, and the drum rotates rapidly to dehydrate the clothes.

After the dehydration process, the washing machine sends out a warning tone reminding that the laundry process has been completed, and then open the machine door and take out the laundry.

The above embodiments are only the preferred embodiments of the present disclosure, and do not limit the scope of the present disclosure. A person skilled in the art may make various other corresponding changes and deformations based on the described technical solutions and concepts. And all such changes and deformations shall also fall within the scope of the present disclosure. It will be obvious to those skilled in the art that changes and modifications may be made, and therefore, the aim in the appended claims is to cover all such changes and modifications.

The invention claimed is:

1. A vibration squeeze drum washing machine, comprising:

a housing;

a barrel, the barrel is configured for holding water;

a drum, the drum defines a plurality of holes for communicated with the barrel, the drum is configured to overturn clothes in the washing and rinsing process and dehydrate the clothes in the dehydration process;

a machine door, the machine door is rotatablely connected to the housing, the machine door provide access to the drum;

a vibration squeeze device, the vibration squeeze device perform a washing function;

a turnover mechanism, the turnover mechanism is configured to enable the vibration squeeze device to turn up and down at 90 degrees relative to the machine door;

a mechanical vibrator;

a position sensor, the position sensor is disposed on the machine door, the position sensor is configured for accurately sensing a overturn state of the vibration squeeze device;

a drum motor;

a drive device, the drive device is connected to the drum for driving the drum to rotate;

a water intake valve, the water intake valve is connected to supply lines;

a drainage valve, the drainage valve is connected to drainage lines; and a control system, the control system controls a connection and disconnection of the power supply of the mechanical vibrator;

wherein the vibration squeeze device is disposed on an inner side of the machine door and is connected to the machine door via the turnover mechanism.

2. The vibration squeeze drum washing machine of claim 1, wherein:

in an upturning position, the vibration squeeze device is parallel to the machine door; and in a downturning position, the vibration squeeze device is perpendicular to the machine door and extends into the lower part of the drum.

3. The vibration squeeze drum washing machine of claim 2, wherein the turnover mechanism comprises:

a motor, a worm, the worm is connected to the worm wheel, the motor is connected to the worm; and a worm wheel, the worm wheel is connected to the vibration squeeze device; the motor drives the worm to rotate to enable the vibration squeeze device to overturn.

4. The vibration squeeze drum washing machine of claim 2, wherein the vibration squeeze device comprises an inner chamber and a mechanical vibrator disposed in the inner chamber.

* * * * *